US010859013B2

(12) United States Patent
Asanuma

(10) Patent No.: US 10,859,013 B2
(45) Date of Patent: Dec. 8, 2020

(54) PUMP MODULE AND EVAPORATED FUEL TREATMENT DEVICE

(71) Applicant: AISAN KOGYO KABUSHIKI KAISHA, Obu (JP)

(72) Inventor: Daisaku Asanuma, Gamagori (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 16/348,687

(22) PCT Filed: Oct. 4, 2017

(86) PCT No.: PCT/JP2017/036180
§ 371 (c)(1),
(2) Date: May 9, 2019

(87) PCT Pub. No.: WO2018/088075
PCT Pub. Date: May 17, 2018

(65) Prior Publication Data

US 2019/0345885 A1 Nov. 14, 2019

(30) Foreign Application Priority Data

Nov. 11, 2016 (JP) ..... 2016-220965

(51) Int. Cl.
*F02D 41/00* (2006.01)
*F02M 25/08* (2006.01)
*F02M 35/10* (2006.01)

(52) U.S. Cl.
CPC ..... *F02D 41/004* (2013.01); *F02D 41/0042* (2013.01); *F02D 41/0045* (2013.01);
(Continued)

(58) Field of Classification Search
CPC .... F02D 41/00; F02D 41/004; F02D 41/0042; F02D 41/0045; F02D 2200/0406; F02M 25/0836; F02M 35/1057
See application file for complete search history.

(56) References Cited

U.S. PATENT DOCUMENTS 9,689,325 B2 6/2017 Nanba
9,759,169 B2 12/2017 Makino
(Continued)

FOREIGN PATENT DOCUMENTS

JP H8-326577 A 12/1996
JP 2002-115605 A 4/2002
(Continued)

OTHER PUBLICATIONS

English translation of International Preliminary Report on Patentability (IPRP) for PCT/JP2017/036180 dated May 22, 2018 (4 pages).
(Continued)

*Primary Examiner* — Hieu T Vo
(74) *Attorney, Agent, or Firm* — Shumaker, Loop & Kendrick, LLP

(57) ABSTRACT

A pump module that is mounted in an evaporated fuel processing device configured to perform a purge process in which evaporated fuel in a fuel tank is supplied to an intake passage of an engine through a purge passage. The pump module may include: a pump configured to pump the evaporated fuel in the purge passage to the intake passage; and a pump controller configured to control drive of the pump. The pump controller may be configured to: during the purge process, drive the pump at a rotational speed equal to or lower than a rotational speed threshold until when a predetermined period has elapsed from a start of the purge process; and after the predetermined period has elapsed,
(Continued)

drive the pump at a rotational speed equal to or higher than the rotational speed threshold.

4 Claims, 5 Drawing Sheets

(52) U.S. Cl.
CPC . *F02M 25/0836* (2013.01); *F02D 2200/0406* (2013.01); *F02M 35/10157* (2013.01)

(56) References Cited

U.S. PATENT DOCUMENTS

| | | | | |
|---|---|---|---|---|
| 10,563,622 | B2 * | 2/2020 | Asanuma | F02M 25/089 |
| 2019/0145354 | A1 * | 5/2019 | Kato | F02M 25/08 |
| 2019/0331036 | A1 * | 10/2019 | Asanuma | F02D 41/003 |
| 2019/0368434 | A1 * | 12/2019 | Asanuma | F02M 25/0836 |

FOREIGN PATENT DOCUMENTS

| | | | |
|---|---|---|---|
| JP | 2006-144601 | A | 6/2006 |
| JP | 2007-198267 | A | 8/2007 |
| JP | 2015-200210 | A | 11/2015 |
| JP | 2016-084797 | A | 5/2016 |

OTHER PUBLICATIONS

English Translation of the International Search Report (ISR) for PCT/JP2017/036180 dated Nov. 14, 2017 (1 pg.).

* cited by examiner

PUMP MODULE AND EVAPORATED FUEL TREATMENT DEVICE

TECHNICAL FIELD

The disclosure herein relates to an evaporated fuel processing device mounted in a vehicle and a pump module mounted in the evaporated fuel processing device.

BACKGROUND ART

Japanese Patent Application Publication No. 2015-200210 describes an evaporated fuel processing device. The evaporated fuel processing device is provided with a canister storing evaporated fuel in a fuel tank, a purge passage communicating the canister and an intake passage of an engine, a pump disposed on the purge passage, and a control valve switching the purge passage between being opened and closed.

The evaporated fuel processing device performs a purge process of supplying the evaporated fuel stored in the canister to the intake passage by opening the control valve and driving the pump. In the purge process, the evaporated fuel stored in the canister is supplied to the intake passage by driving the pump with relatively high rotation. In the evaporated fuel processing device, the pump is kept driven with low rotation even when the control valve is closed. Due to this, as compared to a case where the pump starts to be driven from a state in which the pump is stopped, the pump comes to be driven at a desired rotational speed at a relatively early timing after the purge process has been started.

SUMMARY

Technical Problem

In the above evaporated fuel processing device, the evaporated fuel is supplied to the intake passage by the pump at a relatively early timing after the control valve has been opened. As a result, there may be a case where a fuel amount supplied to the engine abruptly increases immediately after the start of the purge process, by which an air-fuel ratio deviates significantly from a desired air-fuel ratio. The disclosure herein provides a technique that suppresses a large amount of evaporated fuel from being supplied to an intake passage immediately after a start of a purge process.

Solution to Technical Problem

A technique disclosed herein relates to a pump module. The pump module may be mounted in an evaporated fuel processing device configured to perform a purge process in which evaporated fuel in a fuel tank is supplied to an intake passage of an engine through a purge passage. The pump module may comprise a pump configured to pump the evaporated fuel in the purge passage to the intake passage, and a pump controller configured to control drive of the pump. The pump controller may be configured to: during the purge process, drive the pump at a rotational speed equal to or lower than a rotational speed threshold until when a predetermined period has elapsed from a start of the purge process; and after the predetermined period has elapsed, drive the pump at a rotational speed equal to or higher than the rotational speed threshold.

In this configuration, at a timing immediately after the start of the purge process, the pump is either being driven with relatively low rotation or stopped. Due to this, a large amount of the evaporated fuel may be suppressed from being supplied to the intake passage by the pump at the timing immediately after the start of the purge process. As a result, a situation may be avoided in which an air-fuel ratio deviates significantly from a desired air-fuel ratio at the timing immediately after the start of the purge process. Further, when the predetermined period elapses from the start of the purge process, a fuel amount supplied to the engine may be adjusted by taking the evaporated fuel supplied by the purge process into account. As a result, the situation in which the air-fuel ratio deviates significantly from the desired air-fuel ratio may be suppressed even when the pump is driven at the rotational speed equal to or higher than the rotational speed threshold after the predetermined period has elapsed from the start of the purge process, as compared to a case where the pump is driven at the rotational speed equal to or higher than the rotational speed threshold immediately after the start of the purge process.

The evaporated fuel processing device may comprise a control valve disposed on the purge passage between the pump and the intake passage, and configured to switch between a closed state in which the purge passage is closed and an open state in which the purge passage is opened. The control valve may be configured to continuously switch between the closed state and the open state alternately during the purge process. The pump controller may be configured to: drive the pump at the rotational speed equal to or lower than the rotational speed threshold in a case where a divergence is equal to or less than a divergence threshold. The divergence indicates a ratio of a duration for one open state to a total duration for the one open state and one closed state that take place in succession to each other; and drive the pump at the rotational speed equal to or higher than the rotational speed threshold in a case where the divergence is greater than the divergence threshold.

During the purge process, an inside of the purge passage is pressurized by the pump while the control valve is in the closed state. A duration in which the control valve stays in the closed state is long in a case where the divergence of the control valve is small during the purge process, by which the inside of the purge passage is pressurized by the pump over a long period. A pressure in the purge passage becomes higher with a higher rotational speed of the pump. As a result, upon when the control valve switches from the closed state to the open state, the evaporated fuel pressurized by the pump is abruptly supplied to the intake passage. In the aforementioned configuration, the rotational speed of the pump is suppressed low in the case where the divergence of the control valve is less than the predetermined divergence threshold. As a result, a situation in which a large amount of the evaporated fuel is abruptly supplied to the intake passage upon when the control valve switches from the closed state to the open state may be avoided.

The pump controller may be configured to control the rotational speed of the pump according to the divergence. According to this configuration, the rotational speed of the pump may be changed according to the divergence of the control valve.

Another technique disclosed herein relates to an evaporated fuel processing device which comprises any one of the aforementioned pump modules. The evaporated fuel processing device may comprise, other than the one of the aforementioned pump modules, a canister configured to store evaporated fuel, and a control valve disposed on the purge passage between the pump and the intake passage and configured to switch between a closed state in which the purge passage is closed and an open state in which the purge passage is opened.

According to this configuration, a large amount of the evaporated fuel may be suppressed from being supplied to the intake passage by the drive of the pump immediately after the start of the purge process. As a result, the situation in which the air-fuel ratio deviates significantly from the desired air-fuel ratio immediately after the start of the purge process can be suppressed.

The evaporated fuel processing device may further comprise a controller configured to estimate an amount of gas supplied to the intake passage during the purge process according to the rotational speed of the pump. According to this configuration, the fuel amount supplied to the engine can be adjusted by using the estimated amount of gas.

DETAILED DESCRIPTION

First Embodiment

Figure 1:
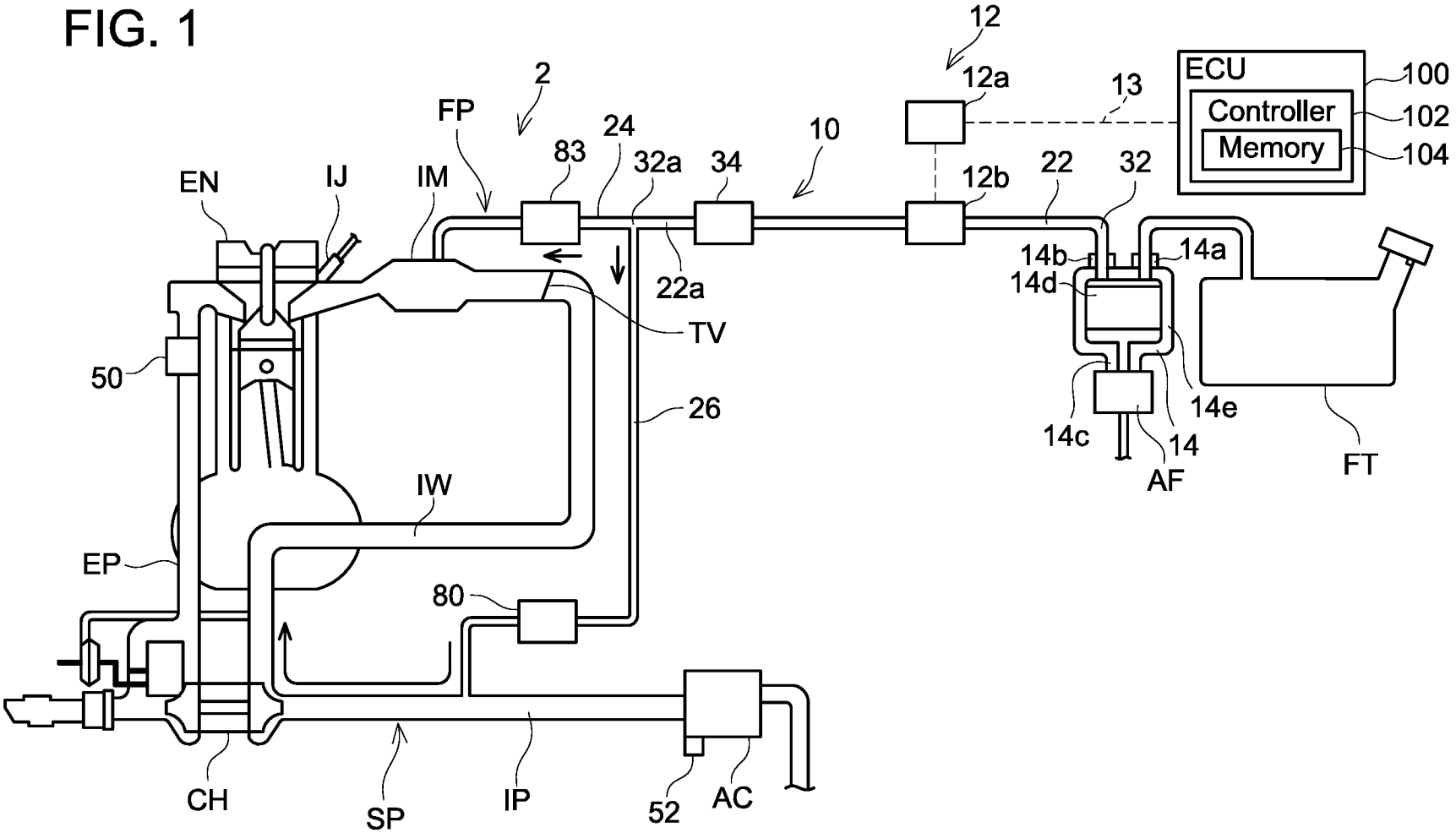
FIG. 1 shows an overview of a fuel supply system in a vehicle.

An evaporated fuel processing device 10 and a pump module 12 mounted in the evaporated fuel processing device 10 will be described with reference to the drawings. As shown in FIG. 1, the evaporated fuel processing device 10 is mounted in a vehicle such as an automobile and is disposed in a fuel supply system 2 configured to supply fuel stored in a fuel tank FT to an engine EN.

The fuel supply system 2 is configured to supply the fuel pumped by a fuel pump (not shown) housed in the fuel tank FT to an injector IJ. The injector IJ includes a solenoid valve of which divergence is adjusted by an Engine Control Unit (ECU) 100 to be described later. The injector IJ is configured to supply the fuel to the engine EN.

An intake pipe IP and an exhaust pipe EP are connected to the engine EN. The intake pipe IP is a pipe to supply air to the engine EN by a negative pressure of the engine EN or by an operation of a supercharger CH. The intake pipe IP defines an intake passage IW. The intake passage IW has a throttle valve TV disposed thereon. The throttle valve TV is configured to adjust a divergence of the intake passage IW to control an amount of air flowing into the engine EN. The throttle valve TV is controlled by the ECU 100. The supercharger CH is disposed on the intake passage IW on an upstream side relative to the throttle valve TV. The supercharger CH is a so-called turbo charger and is configured to rotate a turbine by gas discharged from the engine EN to the exhaust pipe EP to compress air in the intake passage IW and supply the same to the engine EN. The supercharger CH is controlled by the ECU 100.

An air cleaner AC is disposed on the intake passage IW on an upstream side relative to the supercharger CH. The air cleaner AC includes a filter that removes foreign matter from air flowing into the intake passage IW. In the intake passage IW, when the throttle valve TV opens, air is suctioned through the air cleaner AC toward the engine EN. The engine EN combusts the fuel inside the engine EN by using the air and discharges gas to the exhaust pipe EP after the combustion.

In a situation where the supercharger CH is not operating, a negative pressure is generated in the intake passage IW by drive of the engine EN. A situation may be raised in which the negative pressure in the intake passage IW is small, by the drive of the engine EN. Further, in a situation where the supercharger CH is operating, the upstream side relative to the supercharger CH has an atmospheric pressure, while a positive pressure is generated on a downstream side relative to the supercharger CH.

The evaporated fuel processing device 10 is configured to supply evaporated fuel in the fuel tank FT to the engine EN through the intake passage IW. The evaporated fuel processing device 10 includes a canister 14, the pump module 12, a purge pipe 32, a control valve 34, a controller 102 in the ECU 100, and check valves 80, 83. The canister 14 is configured to adsorb the evaporated fuel generated in the fuel tank FT. The canister 14 includes activated charcoal 14*d* and a case 14*e* housing the activated charcoal 14*d*. The case 14*e* includes a tank port 14*a*, a purge port 14*b*, and an air port 14*c*. The tank port 14*a* is connected to an upper end of the fuel tank FT. Due to this, the evaporated fuel in the fuel tank FT flows into the canister 14. The activated charcoal 14*d* is configured to adsorb the evaporated fuel from the gas flowing into the case 14*e* from the fuel tank FT. Due to this, the evaporated fuel can be suppressed from being discharged to open air.

The air port 14*c* communicates with open air through an air filter AF. The air filter AF removes foreign matter from air that flows into the canister 14 through the air port 14*c*.

The purge pipe 32 communicates with the purge port 14*b*. Mixed gas of the evaporated fuel in the canister 14 and air (hereinbelow termed "purge gas") flows from the canister 14 into the purge pipe 32 through the purge port 14*b*. The purge pipe 32 defines purge passages 22, 24, 26. The purge gas in the purge pipe 32 flows through the purge passages 22, 24, 26 and is supplied to the intake passage IW.

The purge pipe 32 branches into two at a branching position 32*a* located between the canister 14 and the intake passage IW. One branch of the purge pipe 32 is connected to an intake manifold IM on an engine EN side (that is, on a downstream side) relative to the throttle valve TV and the supercharger CH, and the other branch of the purge pipe 32 is connected to an air cleaner AC side (that is, on an upstream side) relative to the throttle valve TV and the supercharger CH. The purge passage 22 is defined by the purge pipe 32 on a canister 14 side relative to the branching position 32*a*, the purge passage 24 is defined by the purge pipe 32 connected to the intake pipe IP on the downstream side relative to the branching position 32*a* of the purge pipe 32, and the purge passage 26 is defined by the purge pipe 32 connected to the intake pipe IP on the upstream side relative to the branching position 32*a* of the purge pipe 32.

The pump module 12 is disposed at an intermediate position on the purge passage 22. The pump module 12 includes a pump 12*b* and a pump controller 12*a*. The pump 12*b* is a so-called vortex pump (also called a cascade pump or a Wesco pump), or a centrifugal pump. The pump controller 12*a* is configured to control the pump 12*b*. The pump controller 12*a* includes a control circuit in which a CPU and a memory such as a ROM and a RAM are mounted. The pump controller 12*a* is communicably connected with the ECU 100 via a wiring 13.

A discharge outlet of the pump 12*b* communicates with the purge pipe 32. The pump 12*b* is configured to pump the purge gas to the purge passage 22. The purge gas pumped to the purge passage 22 passes through at least one of the purge passages 24 and 26 and is supplied to the intake passage IW.

The check valve 83 is disposed on the purge passage 24. The check valve 83 is configured to allow gas to flow in the purge passage 24 toward the intake passage IW and prohibit it to flow therein toward the canister 14. The check valve 80 is disposed on the purge passage 26. The check valve 80 is configured to allow gas to flow in the purge passage 26 toward the intake passage IW and prohibit it to flow therein toward the canister 14.

The control valve 34 is disposed on the purge passage 22 between the pump 12*b* and the branching position 32*a*. The control valve 34 is a solenoid valve controlled by the controller 102 in the ECU 100, and is controlled by the controller 102 to switch between an open state of being opened and a closed state of being closed. The controller 102 is configured to perform switching control of continuously and alternately switching the open state and the closed state of the control valve 34 according to a divergence determined based on an air-fuel ratio. In the open state, the purge passage 22 opens, by which the canister 14 and the intake passage IW are communicated. In the closed state, the purge passage 22 is closed, by which the communication between the canister 14 and the intake passage IW is cut off on the purge passage 22. The divergence indicates a ratio of a duration for one open state to a total duration for one open state and one closed state that take place in succession to each other while the control valve 34 is continuously switched between the open state and the closed state. The control valve 34 adjusts a flow rate of gas containing the evaporated fuel (that is, the purge gas) by adjusting the divergence (that is, the duration for the open state). A part of the purge passage 22 that is located on a downstream side relative to the control valve 34 will be termed "purge passage 22*a*".

The controller 102 is a part of the ECU 100 and is integrally disposed with other units of the ECU 100 (such as a unit for controlling the engine EN). The controller 102 includes a CPU and a memory 104 such as a ROM and a RAM. The controller 102 is configured to control the evaporated fuel processing device 10 according to a program stored in the memory 104 in advance. Specifically, the controller 102 outputs a signal to the pump controller 12*a* and causes the pump controller 12*a* to control the pump 12*b*. Further, the controller 102 outputs a signal to the control valve 34 to perform the switch between the open and closed states. That is, the controller 102 is configured to adjust the divergence in the signal outputted to the control valve 34.

The ECU 100 is connected to an air-fuel ratio sensor 50 disposed in the exhaust pipe EP. The ECU 100 detects an air-fuel ratio in the exhaust pipe EP from a detection result of the air-fuel ratio sensor 50 and thereby controls a fuel injection amount from the injector IJ.

Further, the ECU 100 is connected to an air flowmeter 52 disposed near the air cleaner AC. The air flowmeter 52 is a so-called hot-wire air flowmeter, however, it may have another configuration. The ECU 100 receives a signal indicating a detection result from the air flowmeter 52 and detects a gas amount (that is, an intake amount) suctioned to the engine EN through the air cleaner AC.

(Purge Process)

Next, a purge process of supplying the purge gas from the canister 14 to the intake passage IW will be described. When the engine EN is being driven and a purge condition is satisfied, the controller 102 performs the switching control of the control valve 34 to perform the purge process. The purge condition is a condition that is satisfied in a case where the purge process of supplying the purge gas to the engine EN is to be performed, and is a condition set in advance by a manufacturer of the controller 102 based on a cooling water temperature for the engine EN and a specific situation of a concentration of the evaporated fuel in the purge gas (hereinbelow termed "purge concentration"). During when the engine EN is being driven, the controller 102 monitors at all times whether the purge condition is satisfied.

In the purge process, the purge gas is supplied to at least one of the intake passage IW on the downstream side relative to the throttle valve TV from the canister 14 through the purge passages 22, 24 and the intake passage IW on the upstream side relative to the supercharger CH from the canister 14 through the purge passages 22, 26. Which one of the above passages is to be used for the supply changes depending on the pressure in the intake passage IW on the downstream side relative to the throttle valve TV (i.e., the pressure in the intake manifold IM).

In a case where the supercharger CH is not operating, the intake passage IW on the downstream side relative to the throttle valve TV has a negative pressure by the drive of the engine EN. On the other hand, the intake passage IW on the upstream side relative to the throttle valve TV is at a pressure substantially equal to an atmospheric pressure. As a result, the purge gas is primarily supplied from the canister 14 to the intake passage IW on the downstream side relative to the throttle valve TV (that is, into the intake manifold IM) through the purge passages 22, 24. A passage through which the purge gas is supplied from the control valve 34 to the engine EN through the purge passages 22*a*, 24 and the intake passage IW will be termed a first purge passage FP.

On the other hand, while the supercharger CH is operating, the air on the downstream side relative to the supercharger CH is compressed by the supercharger CH. Due to this, the pressure in the intake passage IW on the downstream side relative to the supercharger CH becomes higher than that on the upstream side relative to the supercharger CH. As a result, the purge gas is primarily supplied from the canister 14 to the intake passage IW on the downstream side relative to the supercharger CH through the purge passages 22, 26. The intake passage IW on the downstream side relative to the supercharger CH is at a pressure approximate to the atmospheric pressure, and a slight degree of negative pressure is generated by the supercharger CH. A passage through which the purge gas is supplied from the control valve 34 to the engine EN through the purge passages 22*a*, 26 and the intake passage IW will be termed a second purge passage SP. The second purge passage SP is longer than the first purge passage FP.

While the purge process is being performed, the engine EN is supplied with the fuel supplied through the injector IJ from the fuel tank FT and the evaporated fuel by the purge process. The ECU 100 controls an amount of the fuel supplied from the injector IJ to the engine EN by adjusting the divergence of the injector IJ. Meanwhile, the controller 102 adjusts an amount of the purge gas supplied by the purge process by adjusting the divergence of the control valve 34. Due to this, the fuel amount supplied to the engine EN is adjusted such that the air-fuel ratio of the engine EN becomes an optimal air-fuel ratio (such as an ideal air-fuel ratio).

The fuel amount supplied by the purge process changes according to the purge concentration and a flow rate of the purge gas flowing in the intake passage IW from the control valve 34 (hereinbelow termed "purge flow rate"). The controller 102 adjusts the divergence of the control valve 34 based on the purge concentration and the purge flow rate. The purge concentration is estimated by using the air-fuel ratio. In a variant, the evaporated fuel processing device may be provided with a concentration sensor for detecting the purge concentration (such as a pressure sensor). The purge flow rate is estimated by a pump control process to be described later.

Further, by driving the pump 12*b* during the purge process, the purge gas can be supplied stably even in a case where the negative pressure in the intake passage IW is small.

(Pump Control Process)

Figure 2:
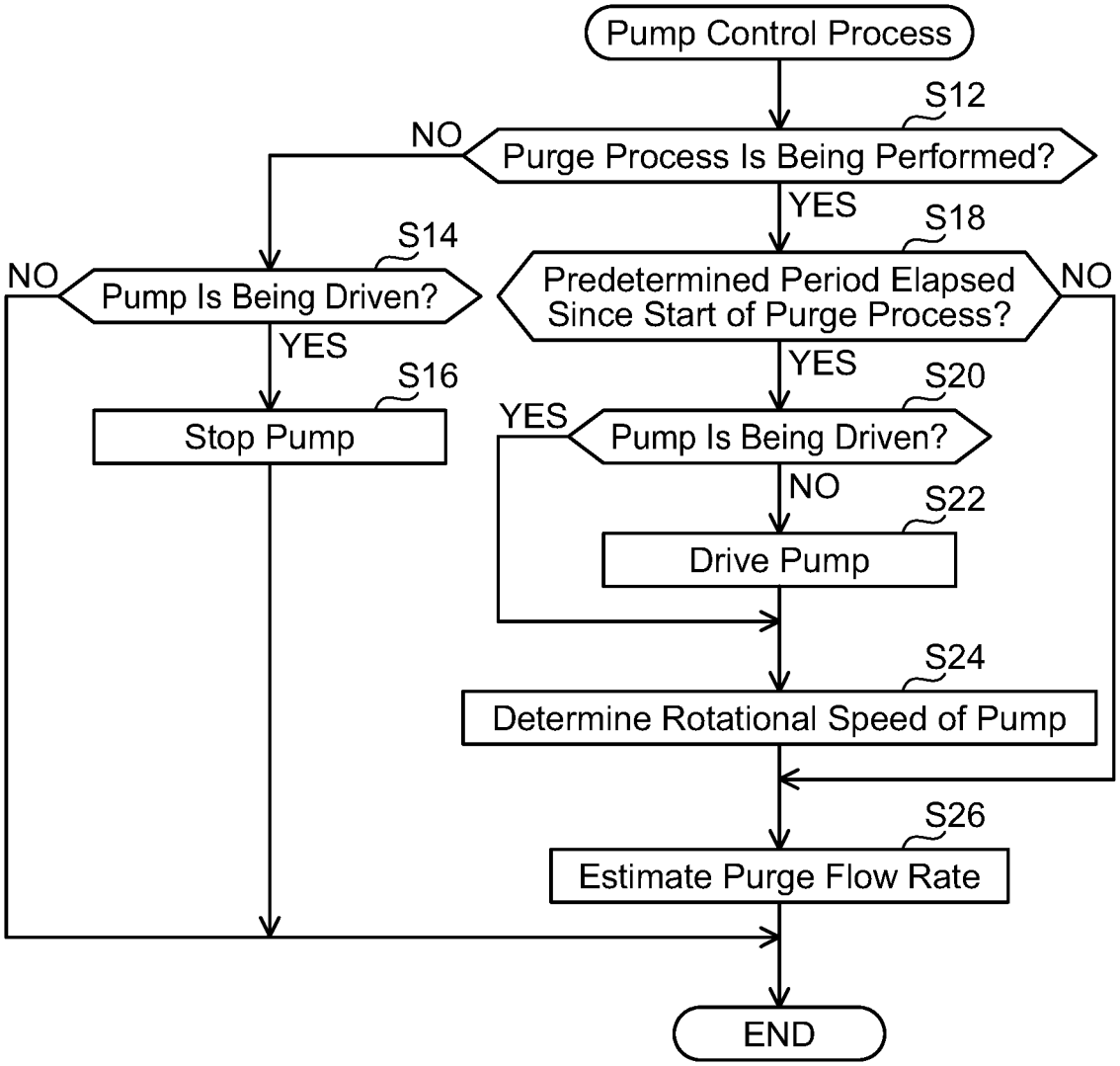
FIG. 2 shows a flowchart of a pump control process according to a first embodiment.

A pump control process which the pump controller 12*a* performs will be described with reference to FIG. 2. The pump control process is performed every predetermined duration (such as 16 ms) since the vehicle has been started (for example, since an ignition switch has been switched from off to on). The pump control process may not be performed periodically.

In the pump control process, firstly in S12, the pump controller 12*a* determines whether or not the purge process is being performed. Specifically, the pump controller 12*a* sends an inquiry to the controller 102 on whether or not it is performing the switching control of the control valve 34. When receiving the inquiry from the pump controller 12*a*, the controller 102 determines whether or not it is performing the switching control of the control valve 34 and sends a determination result to the pump controller 12*a*. The pump controller 12*a* determines that the purge process is being performed in a case where the determination result received from the controller 102 indicates that the switching control is being performed, and determines that the purge process is not being performed in a case where the received determination result indicates that the switching control is not being performed.

In a case of determining that the purge process is not being performed (NO in S12), the pump controller 12*a* determines in S14 whether or not the pump 12*b* is being driven. In a case where the pump 12*b* is being driven (YES in S14), the pump controller 12*a* stops the drive of the pump 12*b* in S16 and terminates the pump control process. On the other hand, in a case where the pump 12*b* is not being driven (NO in S14), S16 is skipped and the pump control process is terminated. Due to this, the pump 12*b* is stopped when the purge process is not performed. That is, a rotational speed of the pump 12*b* is maintained at 0 rpm.

On the other hand, in a case of determining that purge process is being performed (YES in S12), the pump controller 12*a* determines in S18 whether or not a predetermined period has elapsed since the start of the purge process. Specifically, the pump controller 12*a* sends an inquiry regarding a performing duration of the purge process to the controller 102. The controller 102 includes a timer configured to measure the performing duration of the switching control. When receiving the inquiry from the pump controller 12*a*, the controller 102 sends the performing duration measured by the timer to the pump controller 12*a*. When receiving the performing duration from the controller 102, the pump controller 12*a* determines whether or not the performing duration exceeds the predetermined period.

When the purge process is started, the purge gas is supplied to the engine EN and the air-fuel ratio shifts to a rich side. As a result, at least one of control performed by the ECU 100 to reduce the fuel amount from the injector IJ and control performed by the controller 102 to decrease the divergence of the control valve 34 is performed, by which the fuel amount supplied to the engine EN is reduced. Due to this, the air-fuel ratio is adjusted to an optimal air-fuel ratio. The predetermined period includes a period from when the purge process is started until when the air-fuel ratio is adjusted close to the optimal air-fuel ratio, and it may be, for example, 1,000 ms.

In a case where the predetermined period has not elapsed since the start of the purge process (NO in S18), S20 to S24 are skipped and the process is proceeded to S26. On the other hand, in a case where the predetermined period has elapsed since the start of the purge process (YES in S18), the pump controller 12*a* determines in S20 whether or not the pump 12*b* is being driven. In a case where the pump 12*b* is being driven (YES in S20), S22 is skipped and the process is proceeded to S24. On the other hand, in a case where the pump 12*b* is not being driven (NO in S20), the pump controller 12*a* drives the pump 12*b* at a predetermined lowest rotational speed (such as 4,000 rpm) in S22 and proceeds to S24. In S24, the pump controller 12*a* determines a rotational speed of the pump 12*b* and proceeds to S26.

In order to drive the pump 12*b* at a predetermined target rotational speed (such as 10,000 rpm), in S24, the rotational speed of the pump 12*b* is gradually increased from when the pump 12*b* was started to be driven in S22 at the lowest rotational speed. As a result, the situation in which the purge gas is supplied abruptly to the intake passage IW due to an abrupt increase in the rotational speed of the pump 12*b* can be avoided.

Specifically, in S24, the pump controller 12*a* determines the rotational speed of the pump 12*b* by calculating the following equation: "rotational speed of the pump 12*b*=present rotational speed of the pump 12*b*+(target rotational speed−present rotational speed of the pump 12*b*)/coefficient". The coefficient is predetermined by experiments and is determined to a value by which the air-fuel ratio will not deviate significantly due to the increase in the rotational speed of the pump 12*b*. Due to this, the rotational speed of the pump 12*b* is increased each time the process of S24 is performed, by which the rotational speed of the pump 12*b* approaches the target rotational speed. In a variant, S24 may be skipped when the process of S22 is performed and the process is proceeded to S26.

In S26, the pump controller 12*a* estimates the purge flow rate and terminates the pump control process. In S26, the pump controller 12*a* estimates the purge flow rate by using the rotational speed of the pump 12*b*, the pressure in the intake manifold IM, and the divergence of the control valve 34. Specifically, the pump controller 12*a* stores in advance a data map indicating correlations among rotational speeds of the pump 12*b*, pressures in the intake manifold IM, divergences of the control valve 34, and estimated purge flow rates. This data map is specified in experiments by measuring purge flow rates while changing the rotational speed of the pump 12*b*, the pressure in the intake manifold IM, and the divergence of the control valve 34.

The pump controller 12*a* acquires the pressure in the intake manifold IM and the divergence of the control valve 34 from the controller 102. The controller 102 acquires a detection value of a pressure sensor (not shown) disposed in the intake manifold IM. Then, the pump controller 12*a* specifies the estimated purge flow rate corresponding to the acquired pressure in the intake manifold IM and divergence of the control valve 34 and the rotational speed determined in S24 from the data map.

In the pump control process, the pump 12*b* is driven after the predetermined period has elapsed since the start of the purge process (YES in S18). In this configuration, the pump 12*b* is stopped immediately after the start of the purge process. Due to this, a large amount of the evaporated fuel can be suppressed from being supplied to the intake passage IW by the pump 12*b* immediately after the start of the purge process. As a result, the situation in which the air-fuel ratio deviates significantly from the desired air-fuel ratio immediately after the start of the purge process can be avoided. Further, when the predetermined period has elapsed from the start of the purge process, the fuel amount supplied to the engine EN is adjusted by taking the evaporated fuel supplied by the purge process into account. As a result, even if the pump 12*b* is driven at a rotational speed which is equal to or higher than the lowest rotational speed after the predetermined period has elapsed from the start of the purge process, the situation in which the air-fuel ratio deviates significantly from the desired air-fuel ratio can be suppressed.

(Corresponding Relationships)

The pump controller 12*a* as above is an example of "pump controller" and "controller", the state in which the drive of the pump 12*b* is stopped is an example of a state with "the pump at a rotational speed equal to or lower than a rotational speed threshold".

Second Embodiment

Figure 3:
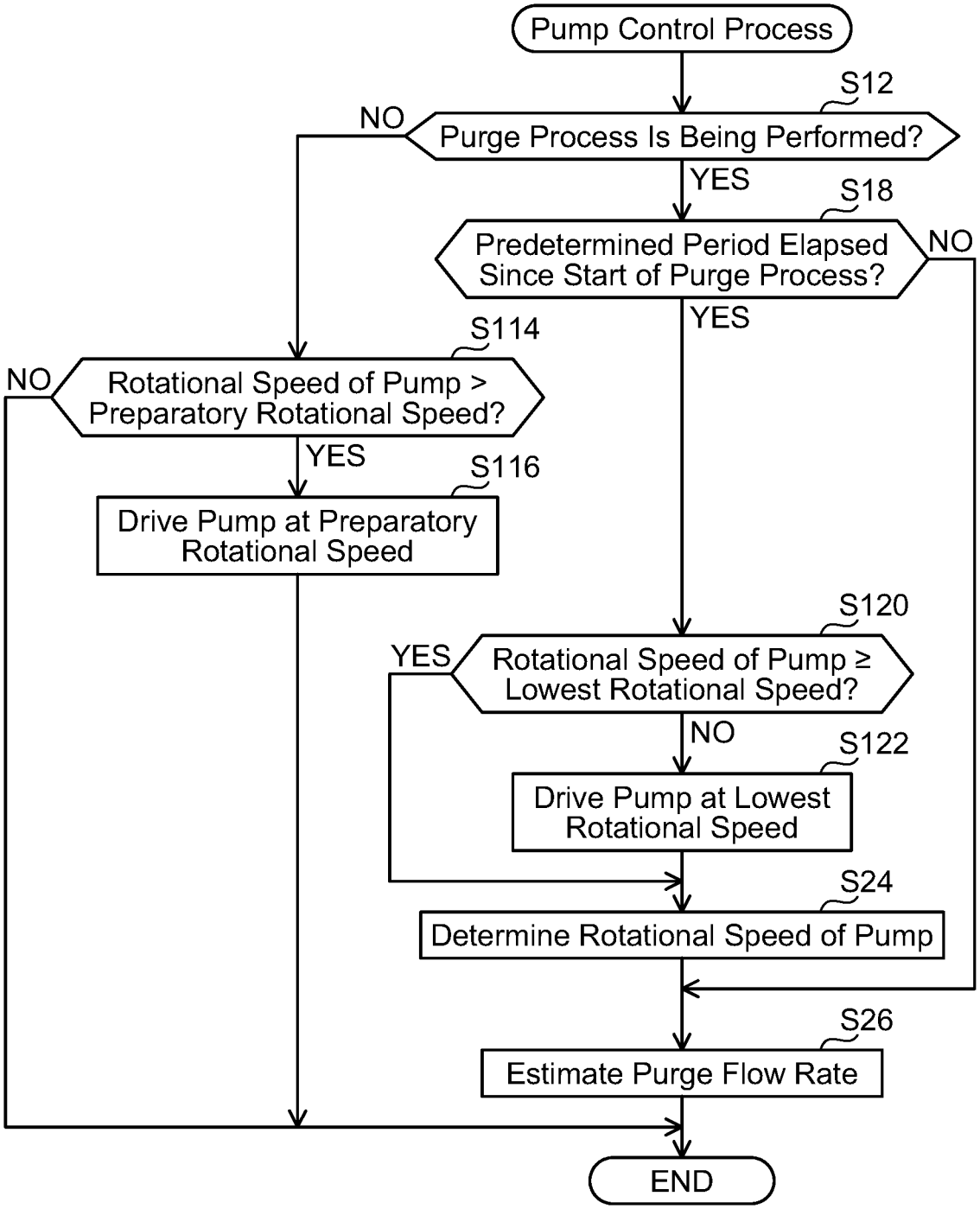
FIG. 3 shows a flowchart of a pump control process according to a second embodiment.

Differences from the first embodiment will be described. In this embodiment, during when the purge process is not being performed, the pump controller 12*a* drives the pump 12*b* at a predetermined preparatory rotational speed (such as 2,000 rpm) which is equal to or lower than the lowest rotational speed. Further, in the present embodiment, as compared to the first embodiment, contents of the pump control process are different. As shown in FIG. 3, in the pump control process of the present embodiment, in the case of determining in S12 that the purge process is not being performed (NO in S12), the pump controller 12*a* determines in S114 whether or not the rotational speed of the pump 12*b* is higher than the preparatory rotational speed. In a case of determining that the rotational speed of the pump 12*b* is higher than the preparatory rotational speed (YES in S114), in S116, the pump controller 12*a* drives the pump 12*b* at the preparatory rotational speed and terminates the pump control process.

On the other hand, in a case of determining that the rotational speed of the pump 12*b* is not higher than the preparatory rotational speed (NO in S114), S116 is skipped and the pump control process is terminated. According to this configuration, during when the purge process is not being performed, the pump 12*b* can be maintained at the preparatory rotational speed.

In the case of determining in S12 that the purge process is being performed (YES in S12), the pump controller 12*a* performs the process of S18. In the case where the predetermined period has not elapsed since the start of the purge process (NO in S18), S120, S122, and S24 are skipped and the process proceeds to S26. On the other hand, in the case where the predetermined period has elapsed since the start of the purge process (YES in S18), in S120, the pump controller 12*a* determines whether or not the rotational speed of the pump 12*b* is equal to or higher than the lowest rotational speed.

In a case where the rotational speed of the pump 12*b* is not equal to or higher than the lowest rotational speed, that is, in a case where the rotational speed of the pump 12*b* is at the preparatory rotational speed (NO in S120), in S122, the pump controller 12*a* drives the pump 12*b* at the lowest rotational speed and proceeds to S24. Due to this, the pump 12*b* can be driven at the lowest rotational speed or higher during when the purge process is being performed.

On the other hand, in a case where the rotational speed of the pump 12*b* is equal to or higher than the lowest rotational speed (YES in S120), S122 is skipped and the process proceeds to S24. Then, the pump controller 12*a* performs the processes of S24 and S26 and terminates the pump control process.

In this configuration, the pump 12*b* disposed on the purge passage 22 is driven at the preparatory rotational speed immediately after the start of the purge process. According to this configuration, a ventilation resistance caused by the pump 12*b* immediately after the start of the purge process can be suppressed.

(Corresponding Relationship)

The preparatory rotational speed is an example of "rotational speed threshold".

Third Embodiment

Differences from the first embodiment will be described. After the purge process has been started, the controller 102 determines a target divergence of the purge gas based on the air-fuel ratio and the like. The controller 102 gradually increases the divergence of the control valve 34 over a predetermined period for achieving the target. Due to this, the purge flow rate can be suppressed low immediately after the start of the purge process.

Figure 4:
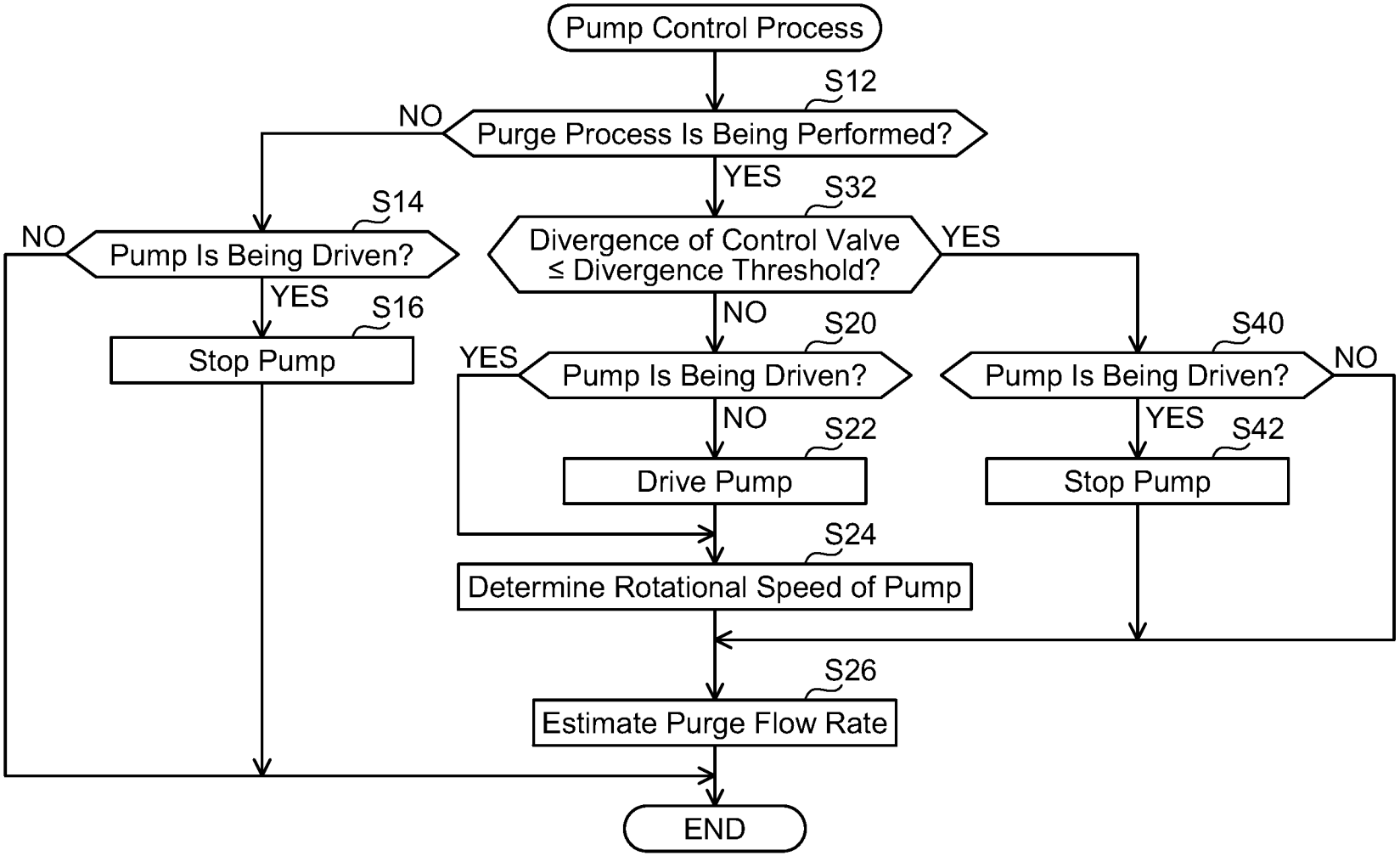
FIG. 4 shows a flowchart of a pump control process according to a third embodiment.

Further, in the present embodiment, as compared to the first embodiment, contents of the pump control process are different. As shown in FIG. 4, in the pump control process of the present embodiment, in the case of determining in S12 that the purge process is being performed (YES in S12), in S32, the pump controller 12*a* determines whether or not the divergence of the control valve 34 is equal to or less than a divergence threshold. Specifically, the pump controller 12*a* sends an inquiry regarding the divergence of the control valve 34 to the controller 102. When receiving the inquiry from the pump controller 12*a*, the controller 102 sends the divergence of the control valve 34 to the pump controller 12*a*. When receiving the divergence of the control valve 34 from the controller 102, the pump controller 12*a* determines whether or not the received divergence is equal to or less than the divergence threshold.

In a case of determining that the divergence is equal to or less than the divergence threshold (YES in S32), in S40, the pump controller 12*a* determines whether or not the pump 12*b* is being driven. In a case where the pump 12*b* is being driven (YES in S40), in S42, the pump controller 12*a* stops the drive of the pump 12*b* (that is, sets the rotational speed of the pump 12*b* to 0) and proceeds to S26. On the other hand, in a case where the pump 12*b* is not being driven (NO in S40), S42 is skipped and the process proceeds to S26.

On the other hand, in a case of determining that the divergence is not equal to or less than the divergence threshold (NO in S32), the processes of S20 to S22 are performed and the process proceeds to S24.

In the aforementioned configuration, the pump 12*b* is stopped in the case where it is determined that the divergence of the control valve 34 is equal to or less than the divergence threshold (YES in S32). In a case where the divergence of the control valve 34 is small, a duration in which the control valve 34 stays in the closed state is relatively long. Due to this, if the rotational speed of the pump 12*b* is high in the case where the divergence of the control valve 34 is small, pressure of the purge gas in the purge passage 22 is significantly increased by the pump 12*b*. Due to this, upon when the control valve 34 switches from the closed state to the open state, a large amount of the purge gas is supplied to the intake passage IW. According to the above configuration, the pump 12*b* is stopped in the case where the divergence of the control valve 34 is small, thus the situation in which the large amount of the purge gas is supplied to the intake passage IW when the control valve 34 switches from the closed state to the open state can be avoided.

On the other hand, in the case where it is determined that the divergence of the control valve 34 is greater than the divergence threshold (NO in S32), the pump 12*b* is driven. In a case where the divergence of the control valve 34 is large, the duration in which the control valve 34 stays in the closed state is relatively short. Due to this, even if the rotational speed of the pump 12*b* is high, the control valve 34 switches from the closed state to the open state before the pressure of the purge gas in the purge passage 22 is increased significantly by the pump 12*b*, thus the situation in which the large amount of the purge gas is supplied to the intake passage IW is less likely to occur. In other words, the divergence threshold in S32 is set to a divergence by which the pressure of the purge gas in the purge passage 22 is not increased significantly by the pump 12*b*.

Further, the divergence of the control valve 34 is gradually increased for a while after the start of the purge process, thus it is determined that the divergence of the control valve 34 is equal to or less than the divergence threshold. As such, in this embodiment as well, the pump 12*b* is stopped during when the purge process is being performed until the predetermined period has elapsed since the start of the purge process.

Fourth Embodiment

Figure 5:
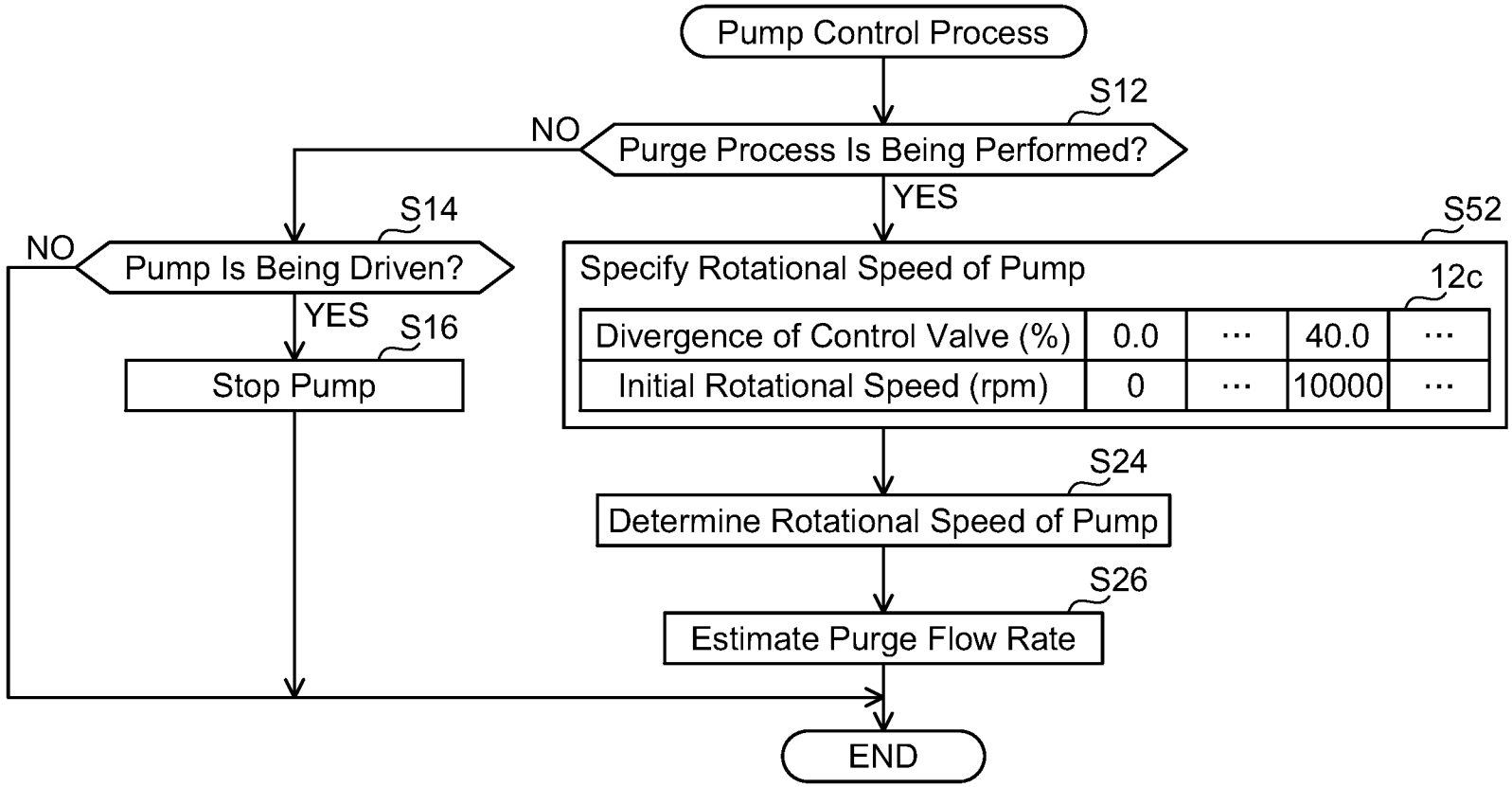
FIG. 5 shows a flowchart of a pump control process according to a fourth embodiment.

Differences from the third embodiment will be described. In the present embodiment, as compared to the third embodiment, contents of the pump control process are different. As shown in FIG. 5, in the pump control process of the present embodiment, in the case where the purge process is being performed (YES in S12), the pump controller 12*a* determines a rotational speed of the pump 12*b* according to the divergence of the control valve 34 in S52, instead of performing the processes of S20, S22, S32, S40, and S42. Specifically, the pump controller 12*a* receives the divergence of the control valve 34 from the controller 102 similar to S32 and specifies the rotational speed corresponding to the received divergence of the control valve 34 from a data map 12*c*. The data map 12*c* is stored in the pump controller 12*a* in advance. In the data map 12*c*, rotational speeds of the pump 12*b* are set according to divergences of the control valve 34 so that the pressure in the purge passage 22 is not significantly increased by the pump 12*b* while the control valve 34 is in the closed state. Further, in the case where the divergence of the control valve 34 is equal to or less than the divergence threshold, the rotational speed of the pump 12*b* is maintained at 0, that is, in the state where the drive of the pump 12*b* is stopped. Although not shown in FIG. 5, in the data map 12*c*, rotational speeds are associated with plural divergences except for divergences of 0.0% and 40.0%.

While specific examples of the present disclosure have been described above in detail, these examples are merely illustrative and place no limitation on the scope of the patent claims. The technology described in the patent claims also encompasses various changes and modifications to the specific examples described above.

(1) In the pump control processes of the third and fourth embodiments, in the case of YES in S12, the process of S18, that is, the determination on whether or not the predetermined period has elapsed since the start of the purge process, may be performed. Then, the pump controller 12*a* may proceed to S32 in the case of YES in S18, and may proceed to S24 in the case of NO in S18.

(2) Further, in the third and fourth embodiments, the pump 12*b* may be driven at the preparatory rotational speed in the case where the purge process is not being performed, as in the second embodiment.

(3) In the first to fourth embodiments, the pump control processes may be performed during when the purge process is being performed. In this case, the processes performed in S12 and in the case of NO in S12 (such as the processes of S14 and S16) may not be performed.

(4) In the first and second embodiments, in the pump control processes, the pump 12*b* may be driven at the target rotational speed in S22 and S122. In this case, the process of S24 may not be performed. Similarly, in the third and fourth embodiments, in the pump control processes, the pump 12*b* may be driven at the target rotational speed in S22 and S52. In this case, the process of S24 may not be performed.

(5) The process of S26, that is, the process of estimating the purge flow rate, may be performed by the controller 102 or the ECU 100.

(6) The controller 102 may be arranged separately from the ECU 100. Further, the pump controller 12*a* and the controller 102 may be arranged integrally.

(7) In the above embodiments, the pump control processes shown in FIGS. 2 to 5 are performed by the pump controller 12*a*. However, the pump control processes may be performed by the controller 102. In this case, the pump controller 12*a* may perform control of the drive of the pump 12*b*. In this variant, the controller 102 and the pump controller 12*a* are an example of "pump controller".

(8) The evaporated fuel processing device 10 may not be provided with one of the purge passages 24 and 26. That is, the purge pipe 32 may not be branched.

(9) In the first and second embodiments, the control valve 34 may be a valve capable of changing a valve open area, that is, may be, for example, a servo valve. In this case, the divergence may be a ratio of an open area to an open area of fully opened control valve 34.

(10) The evaporated fuel processing device 10 may not be provided with the canister 14.

The technical elements explained in the present description or drawings provide technical utility either independently or through various combinations. The present disclosure is not limited to the combinations described at the time the claims are filed. Further, the purpose of the examples illustrated by the present description or drawings is to satisfy multiple objectives simultaneously, and satisfying any one of those objectives gives technical utility to the present disclosure.

The invention claimed is:

1. A pump module mounted in an evaporated fuel processing device configured to perform a purge process in which evaporated fuel in a fuel tank is supplied to an intake passage of an engine through a purge passage, the pump module comprising:

a pump configured to pump the evaporated fuel in the purge passage to the intake passage; and a pump controller configured to control drive of the pump, wherein the pump controller is configured to:

during the purge process, drive the pump at a rotational speed equal to or lower than a rotational speed threshold until when a predetermined period has elapsed from a start of the purge process; and after the predetermined period has elapsed, drive the pump at a rotational speed equal to or higher than the rotational speed threshold, the evaporated fuel processing device comprises a control valve disposed on the purge passage between the pump and the intake passage, and configured to switch between a closed state in which the purge passage is closed and an open state in which the purge passage is opened, the control valve is configured to continuously switch between the closed state and the open state alternately during the purge process, and the pump controller is configured to:

drive the pump at the rotational speed equal to or lower than the rotational speed threshold in a case where a divergence is equal to or less than a divergence threshold, the divergence indicating a ratio of a duration for one open state to a total duration for the one open state and one closed state that take place in succession to each other; and drive the pump at the rotational speed equal to or higher than the rotational speed threshold in a case where the divergence is greater than the divergence threshold.

2. The pump module as in claim 1, wherein the pump controller is configured to control the rotational speed of the pump according to the divergence.

3. An evaporated fuel processing device mounted in a vehicle, the evaporated fuel processing device comprising:

the pump module as in claim 1;

a canister configured to store evaporated fuel; and a control valve disposed on the purge passage between the pump and the intake passage, and configured to switch between a closed state in which the purge passage is closed and an open state in which the purge passage is opened.

4. The evaporated fuel processing device as in claim 3, further comprising:

a controller configured to estimate an amount of gas supplied to the intake passage during the purge process according to the rotational speed of the pump.

* * * * *